US005263064A

United States Patent [19]

Sappey

[11] Patent Number: 5,263,064

[45] Date of Patent: Nov. 16, 1993

[54] DEVICE FOR LOCKING A FUEL ASSEMBLY IN A TRANSPORT CONTAINER

[75] Inventor: Philippe Sappey, Condrieu, France

[73] Assignees: Framatome, Courbevoie; Cogema, Velizy-Villacoublay, both of France

[21] Appl. No.: 857,489

[22] Filed: Mar. 25, 1992

[30] Foreign Application Priority Data

Mar. 25, 1991 [FR] France ..... 91 03583

[51] Int. Cl.[5] ..... G21C 19/06

[52] U.S. Cl. ..... 376/261; 376/272; 410/120

[58] Field of Search ..... 376/261, 260, 272; 976/DIG. 247, DIG. 344, DIG. 352, DIG. 341; 410/120, 127, 128; 248/316.5, 316.1

[56] References Cited

U.S. PATENT DOCUMENTS 2,472,662 6/1949 King ..... 248/316.5
3,327,647 6/1967 Rolfe, Jr. ..... 410/127
3,732,427 5/1973 Trudeau et al. ..... 376/272
4,780,268 10/1988 Papai et al. ..... 376/272

FOREIGN PATENT DOCUMENTS 1816856 7/1970 Fed. Rep. of Germany ..... 376/272

*Primary Examiner*—Daniel D. Wasil
*Attorney, Agent, or Firm*—Pollock, Vande Sande & Priddy

[57] ABSTRACT

The device (25, 26) comprises a tubular body (40) mounted axially movable on a flange (5) of a transport structure (4) for an object (6), a spring (36) for return of the tubular body (40) towards an unclamped position, an arrangement for manual displacement (19, 20, 16, 21) of the tubular body (40) between its unclamped position and a clamping position, carried by the flange (5), a rod mounted slidably in the axial direction of the tubular body (40) to a limited extent and carrying a shoe (14, 15), and a second spring for elastic return interposed between an abutment fastened to the tubular body (40) and the end of the sliding rod opposite the shoe (14, 15).

10 Claims, 7 Drawing Sheets

DEVICE FOR LOCKING A FUEL ASSEMBLY IN A TRANSPORT CONTAINER

FIELD OF THE INVENTION

The invention relates to a device for fastening an object to a transport structure, and more particularly to a device for locking a fuel assembly for nuclear reactors in a transport container.

BACKGROUND OF THE INVENTION

Fuel assemblies for nuclear reactors, and particularly for pressurized water nuclear reactors consist of a bundle of fuel rods of great length which are held in a framework in such a way that the rods are parallel to one another and are arranged in a regular network in the transverse planes of the assembly perpendicular to its longitudinal direction.

The fuel rods are held by spacer grids uniformly spaced over the length of the assembly and forming elements of the framework.

The fuel assemblies of the pressurized-water nuclear reactors in operation at the present time have a length of over four meters and a square cross-section of the order centimeters on each side nuclear reactors having a power of 900 MW comprise eight spacer grids uniformly spaced over the length of the assembly, and fuel assemblies intended for reactors having a power of 1300 MW comprise ten spacer grids. The outer lateral faces of the spacer grids project slightly in relation to the bundle of fuel rods of the assembly.

To carry out the transport of fuel assemblies, for example new fuel assemblies intended for refuelling the core of a nuclear reactor, containers, in which two fuel assemblies are arranged and locked during transport, are employed.

The transport containers comprise lower and upper half-shells which can be assembled together by screwing and of which the lower half-shell receives an underframe or cradle for supporting the fuel assemblies and of which the upper half-shell forms the cover of the container.

The underframe supporting the fuel assemblies consists of an elongate structure, the T-shaped cross-section of which provides, for each of the fuel assemblies, two right-angled bearing surfaces arranged on either side of the middle part of the cradle forming a partition wall for the two assemblies.

The cradle rests within the lower half-shell of the container by means of shock-absorbing studs.

Each of the assemblies arranged in the container comes to bear against the cradle with two successive lateral faces at 90° C. of its spacer grids. The clamping of the assemblies against the bearing faces of the cradle is ensured by flanges arranged level with each of the spacer grids of the assemblies.

In the prior art, level with each of the spacer grids of each of the fuel assemblies in the transport position on the cradle, two half-flanges are mounted in an articulated manner on the cradle so as to be capable of being turned down in the direction of the fuel assembly and of the supporting surfaces when the assembly is being fastened. The half-flanges in the turned-down position are connected to one another by means of a screw connection. Each of the half-flanges carries a device for clamping the assembly, consisting of a threaded rod engaged in the corresponding half-flange and carrying a bearing shoe at its end. The clamping of the assembly is ensured by bringing the shoes to bear with some pressure on the outer lateral surfaces of the spacer grids opposite the faces of these spacer grids bearing on the cradle, by means of a nut and a lock nut which are engaged on the threaded rod.

To ensure the clamping and flanging of the assembly on the cradle, it is therefore necessary to turn down each of the two half-flanges, to ensure the assembling together of the two half-flanges by clamping the screw connection and to bring the shoes to bear by torque-clamping each of the nuts.

These operations, which must be carried out for each of the spacer grids of the fuel assemblies, are relatively time-consuming and require the attendance of well-trained personnel, insofar as a defective fastening of the assemblies occurring as a result of insufficient clamping can result in damage to the assemblies during their transport. Likewise, excessive clamping of the shoes can cause damage to the spacer grids of the assemblies.

Moreover, the use of wrenches for clamping the screw connections and the nuts of the shoes entails some risk that these wrenches, which are of large mass, will fall onto the fuel assemblies and that the rods of the assemblies will therefore be damaged. Falling can also cause physical injuries to the operators responsible for putting the fuel assemblies into the container.

It is clear that the clamping devices according to the prior art also have similar disadvantages when the fuel assemblies are unloaded after a container has been opened. In fact, it is necessary to unclamp the shoes and the flanges before the cradle and the assemblies have been raised vertically, for example by the use of a mechanical device for raising the underframes.

In more general terms, in many sectors of industry, it is necessary to transport heavy components inside containers or on transport underframes, after effective clamping or flanging of the components.

This clamping of the components on their transport underframe is generally carried out by the use of screw connections fastened to a flanging part of the structure opposite the bearing surfaces of the object to be transported.

The clamping torque of these screw connections has to be carefully controlled.

The corresponding operations are therefore relatively time-consuming and difficult and usually require the attendance of highly competent personnel.

SUMMARY OF THE INVENTION

The object of the invention is to provide a device for fastening an object to a transport structure having at least one bearing surface, on which the object rests, and a flanging part located opposite the bearing surface, this device enabling to effective fastening of the object to the structure in a simple and rapid way, without causing damage to the object to be fastened as a result of excessive clamping.

To this end, the device according to the invention comprises:

- a tubular body mounted for axial movement on the flanging part of the transport structure between a clamping position and an unclamped position,
- a first means for elastic return of the tubular body towards its unclamped position, interposed between the tubular body and the flanging part of the structure, a means of manual axial displacement of the tubular body between its unclamped position and its clamping position, carried by the flanging part and comprising a means of locking on the flange in the clamping position, a piston having a rod mounted for limited axial sliding movement within the tubular body and carrying at one of its ends, outside the tubular body, a shoe directed towards the bearing surface of the transport structure, and a second elastic return means, interposed between an abutment fastened to the tubular body and the end of the piston rod opposite the shoe, in order to return the piston rod and the shoe in the direction of the bearing surface.

The invention also relates to a device for locking a fuel assembly in a transport container.

BRIEF DESCRIPTION OF THE DRAWING

To facilitate comprehension of the invention, an embodiment of the device according to the invention, used for locking fuel assemblies of a pressurized-water nuclear reactor in transport containers, will now be described by way of example with reference to the accompanying drawings.

FIG. 10 shows the device in unlocked position.

FIG. 11 shows the device in locked position.

DESCRIPTION OF PREFERRED EMBODIMENT

Figure 1:
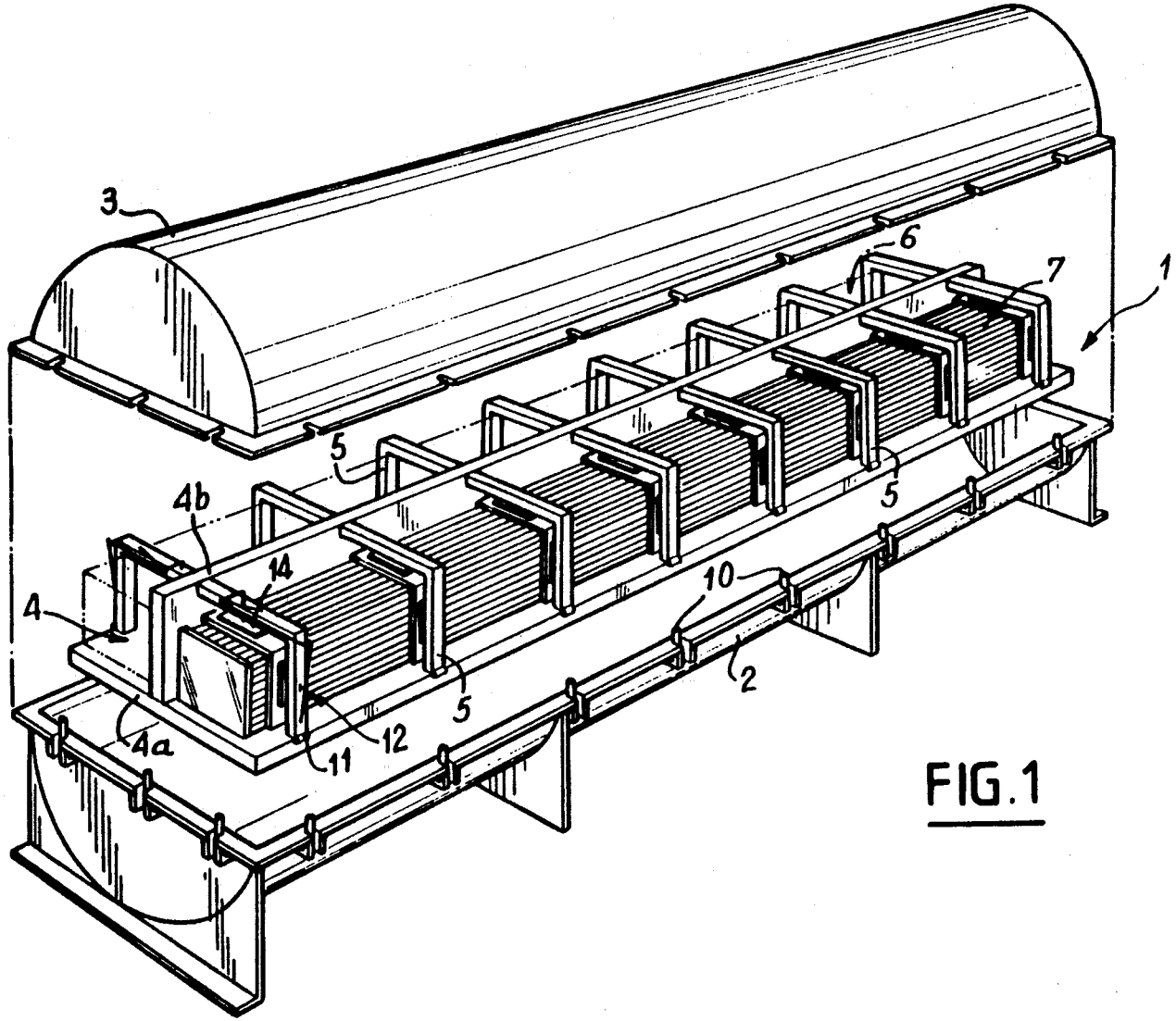
FIG. 1 is a perspective view of a transport container for fuel assemblies of a pressurized-water reactor, the cover of which is open and which contains two assemblies in the transport position.

FIG. 1 shows a transport container 1 for fuel assemblies, consisting of a lower half-shell 2 and an upper half-shell 3 which have substantially semi-cylindrical shapes.

Arranged in the lower half-shell 2 over its entire length is a fuel-assembly supporting underframe 4 or cradle, the cross-section of which is T-shaped.

The cradle 4 comprises a base 4*a* and a partition wall 4*b* perpendicular to the base 4*a*.

The partition wall 4*b* delimits two bearing zones, each having the form of a right-angled dihedron, for two fuel assemblies 6 and 7 on the cradle 4.

The container 1 and the cradle 4 are slightly longer than the fuel assembly, longer than four meters in the case of fuel assemblies for a pressurized-water nuclear reactor.

The fuel assemblies 6 and 7 are held on the cradle 4 by means of locking flanges 5 arranged level with each of the spacer grids of the fuel assemblies 6 and 7 and equipped with fastening devices according to the invention which will be described hereinbelow.

The cradle 4 is held within the lower half-shell 2 by means of shock-absorbing devices (not shown).

The half-shell 3 forms a closing cover for the container, and can be fastened to the lower half-shell 2 by means of screw connections 10 in two parts.

Figure 2:
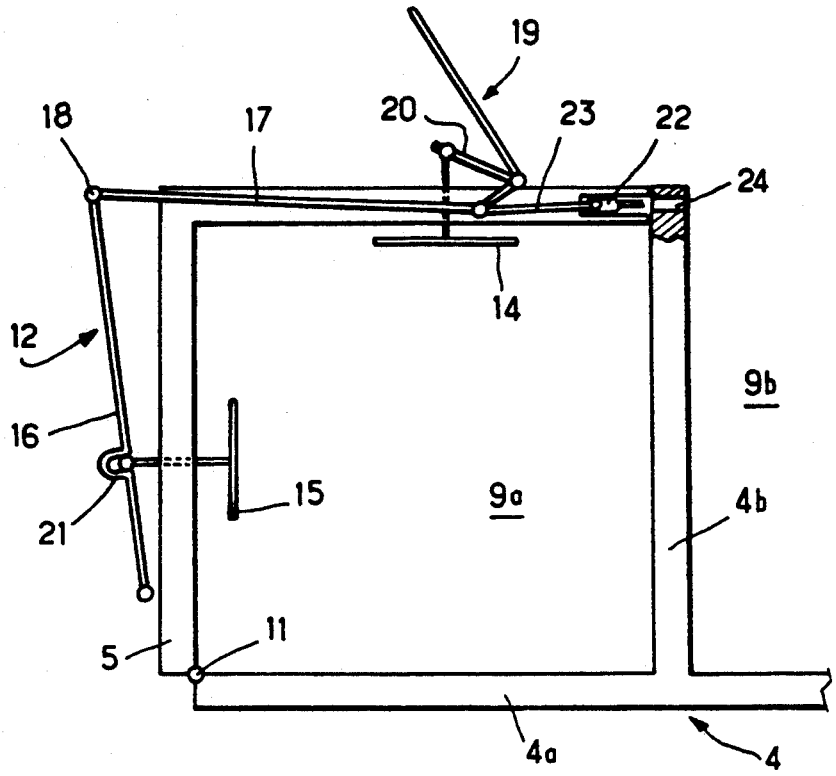
FIG. 2 is a sectional half-view of the supporting cradle of the fuel assemblies in the region of a locking flange in closed position.

FIG. 2 shows the cradle 4 of a fuel-assembly transport container, the partition wall 4*b* of which delimits two bearing zones 9*a*, 9*b* in the form of a right-angled dihedron for two fuel assemblies.

A locking flange 5 arranged level with a spacer grid of a fuel assembly intended to come to rest in the zone 9*a* has been shown diagrammatically.

The flange 5 is in one-piece form and has two branches of the same length arranged at right angles.

The flange 5 is connected to the cradle 4 along the outer lateral edge of the bearing plate 4*a* by means of a hinge 11, the axis of which is parallel to the outer edge of the plate 4*a*.

In the turned-down position of the flange illustrated in FIG. 2, the two branches at 90° of the flange 5 are parallel to the bearing faces of the zone 9*a* and delimit with these a contour of square shape, the side of which is larger than the side of a fuel assembly of square cross-section, such as one of the assemblies 6 or 7.

A manually controlled articulated locking set 12 is fastened to the flange 5. The locking set 12 carries two fastening devices according to the invention, each comprising a bearing shoe 14 or 15 placed opposite a bearing surface of the cradle 4 in the closing position of a flange 5. The locking device 12 comprises two operating rods 16 and 17 articulated on one another by means of an articulation axle 18 parallel to the longitudinal direction of the cradle 4 and an operating key or lever 19, bent at right angles, articulated on the flange 5 and connected in an articulated manner to the end of the rod 17 opposite the joint 18. The two right-angled branches of the lever 19 are of unequal lengths; the longer branch forms the handle of the lever; the rod 17 of the set 12 is articulated on the end of the shorter branch.

The operating rod 16 is connected in an articulated manner to the flange 5 at its end opposite the joint 18.

The axes of articulation of the device 12 are all parallel to one another.

The shoe 14 is controlled by a bearing block 20 articulated on the lever 19 about the axis of articulation of the lever 19 on the flange 5. The shoe 15 is controlled by a bearing block 21 connected to the operating rod 16.

A lock 22 is fastened to the end of a rod 23 articulated on the operating lever 19 in the extension of the operating rod 17.

The upper part of partition wall 4*b* comprises an orifice 24 into which the bolt of the lock 22 is capable of engaging in order to ensure the locking of the flange 5 on the cradle 4.

The locking of the two flanges arranged on either side of the wall 4*b* in the same arrangement over the length of the container can be carried out with a single lock 22, the bolt of which engages into the second flange 5 placed in a position symmetrical relative to the wall 4*b* of the cradle 4.

Figure 3:
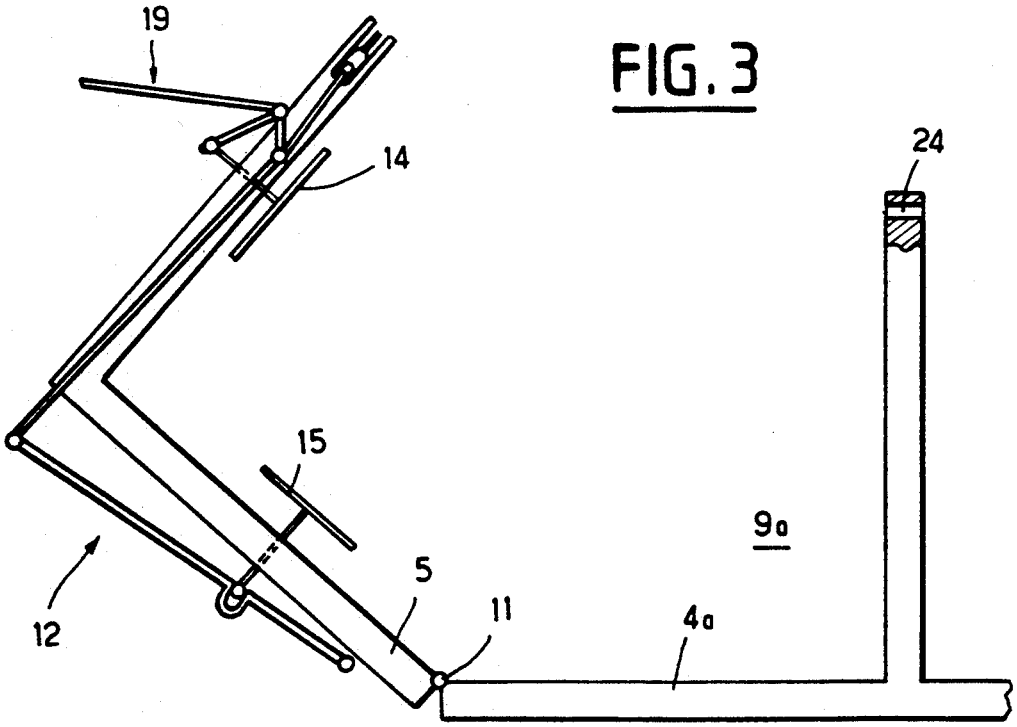
FIG. 3 is a sectional half-view, similar to that of FIG. 2, of the cradle in the region of a flange in open position.

As can be seen in FIG. 3, the flange 5 can be displaced from its closed and locked position shown in FIG. 2 into an opening position by manually pivoting the flange 5 about the hinge 11 by means of the lever 19.

With the set of flanges 5 articulated on the cradle 4 on the same side as the zone 9*a* being placed in their opening position, as shown in FIG. 3, it is possible to deposit a fuel assembly 6 into the zone 9*a* in such a way that one of the corners of the assembly comes into coincidence with the dihedral angle of the bearing zone 9*a*.

Figure 4:
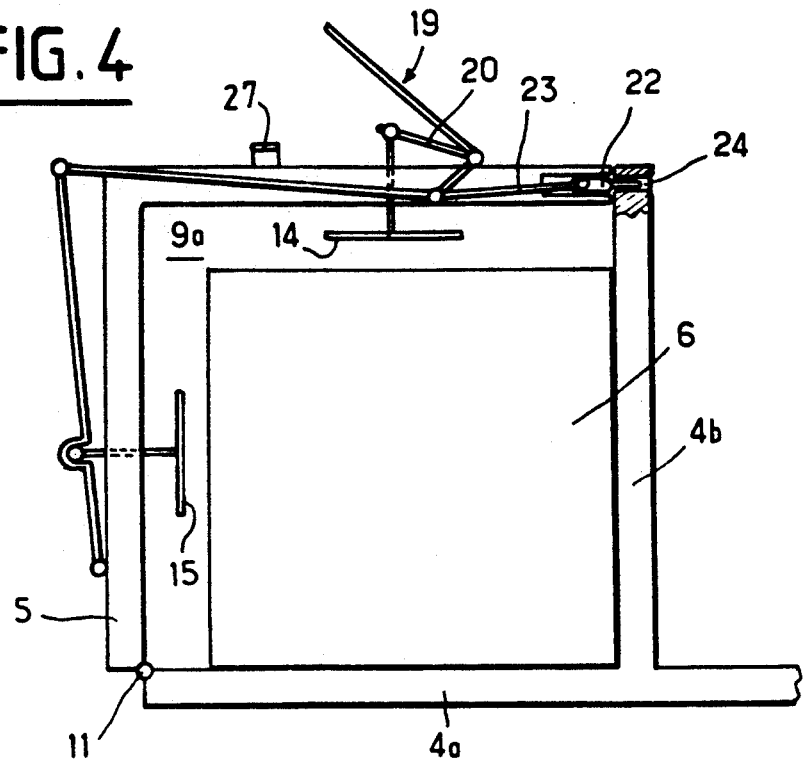
FIG. 4 is a sectional half-view, similar to those of FIGS. 2 and 3, of the cradle on which a fuel assembly is arranged in the region of a flange in the closed and locked position.

FIG. 4 shows a fuel assembly 6 in the position bearing on the cradle 4 in the zone 9*a*.

After the fuel assembly 6 has been deposited onto the cradle 4, the flanges 5 can be turned down into the closed position and then locked by means of the lock 22, as shown in FIG. 4.

Figure 5:
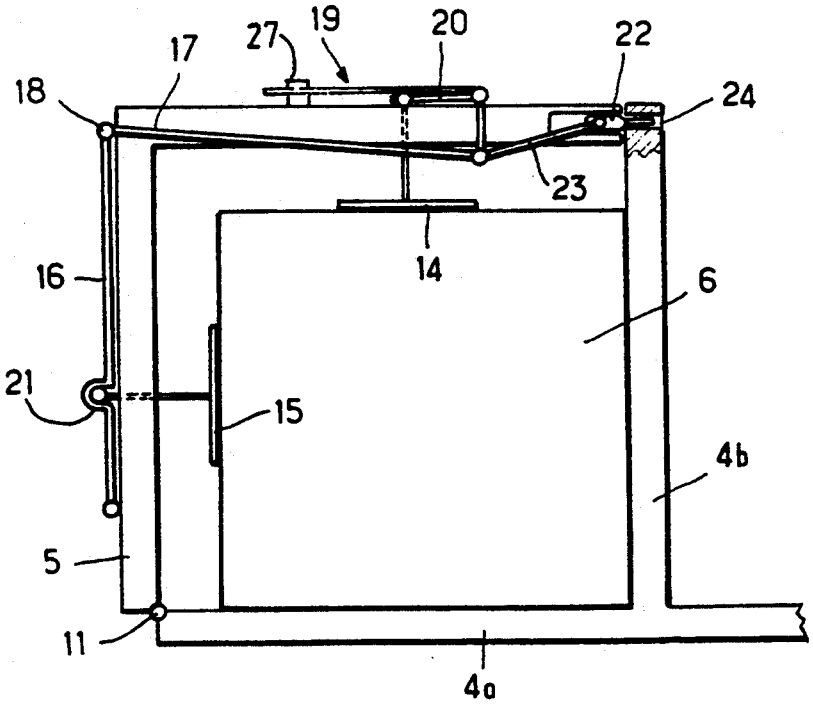
FIG. 5 is a sectional half-view, similar to that of FIG. 4, with the fuel assembly in locked position.

The shoes 14 and 15 of the fastening devices according to the invention are subsequently displaced into the clamping position by turning down the lever 19 completely (FIG. 5).

As can be seen in FIG. 5, the lever 19 ensures the turning down of the bearing block 20 and the clamping of the shoe 14 against the assembly 6. The corresponding displacement of the rod 16 ensures the displacement of the bearing block 21 and the clamping of the second shoe 15 against the assembly 6. A mechanical locking means 27 ensures that the lever 19 is retained in its clamping position shown in FIG. 5.

Figure 6:
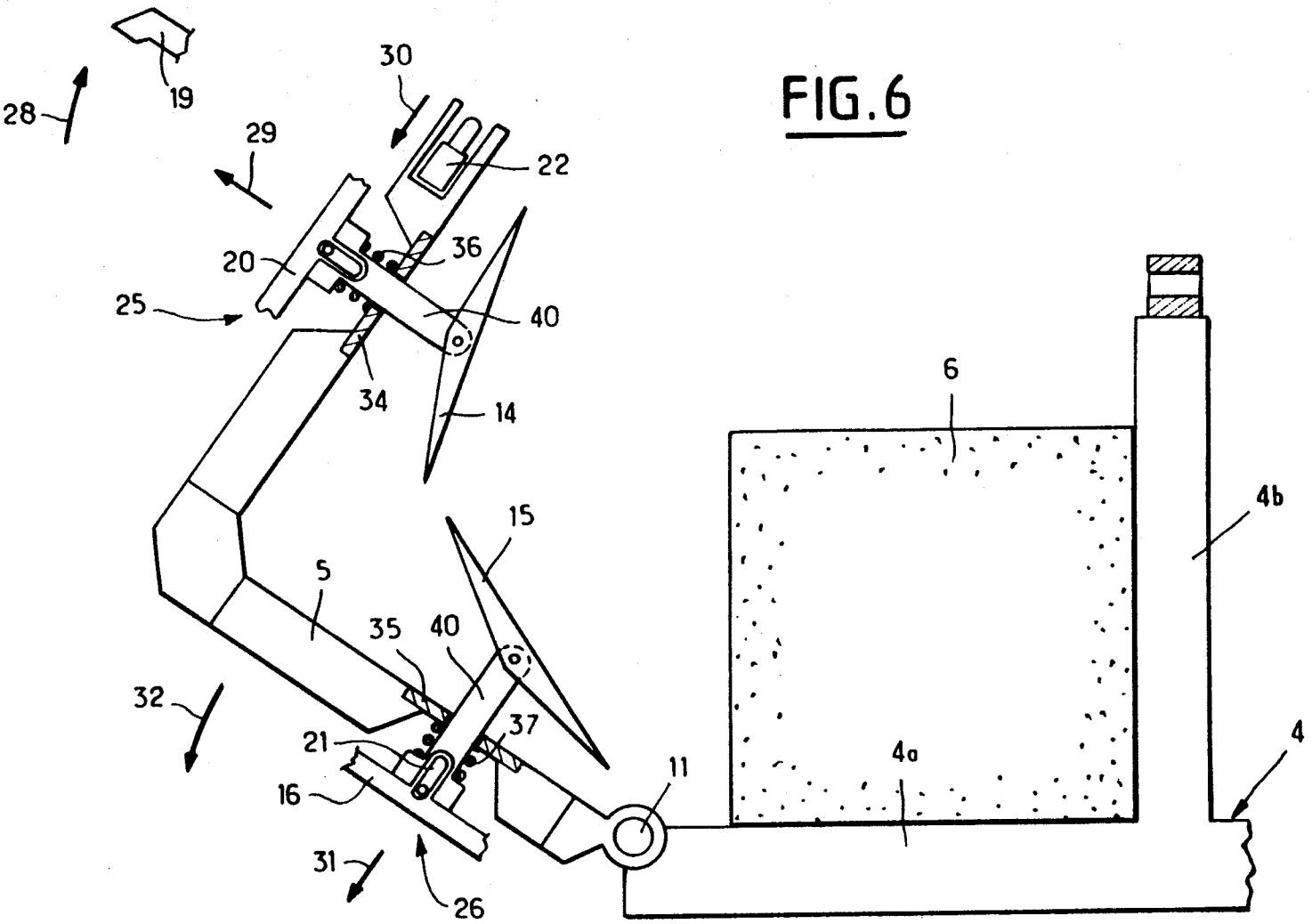
FIG. 6 is a sectional half-view of the cradle, on which a fuel assembly rests, and of a flange in open position, comprising devices for fastening the assembly according to the invention.
Figure 7:
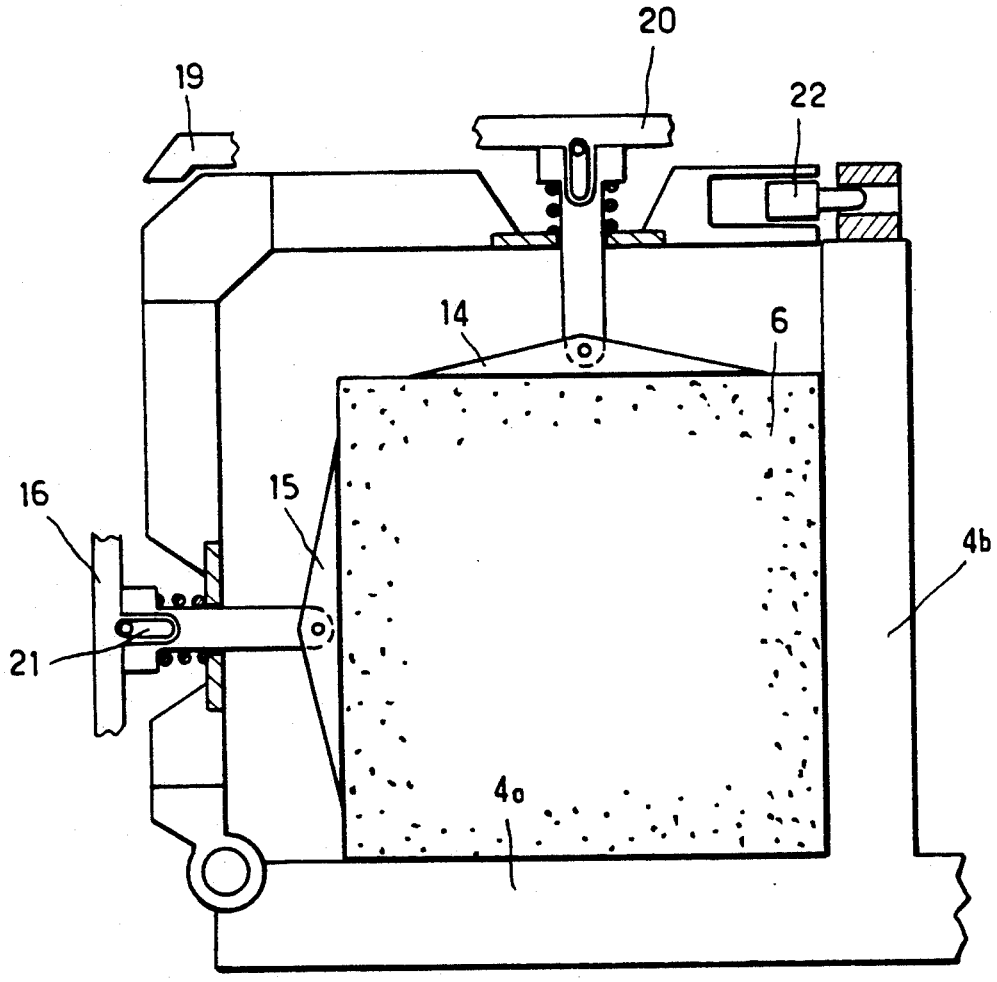
FIG. 7 is a sectional half-view similar to that of FIG. 6, the flange being in closed and locked position.

As can be seen in FIGS. 6 and 7, each of the flanges 5 mounted in an articulated manner on the cradle 4 about a hinge 11 carries two devices 25 and 26 for fastening and clamping the fuel assembly, comprising respectively the shoes 14 and 15 as clamping elements which come into contact with the two outer faces of the fuel assembly 6 in their clamping position, as can be seen in FIG. 7.

In the opening position of the flange shown in FIG. 6, the operating key 19 is in a raised position, so that the bearing block 20 of the clamping device 25 is itself in a raised position. The shoe 14 is returned in the direction of the flange 5.

The displacement of the operating key into the raised position, that is to say distant from the flange 5, as represented by the arrow 28 in FIG. 6, brings about, at the same time as the displacement of the bearing block 20 towards a raised position (arrow 29), a displacement of the rod 17 (see FIG. 2) in the direction of the arrow 30.

The displacement of the rod 17 in the direction of the arrow 30 brings about a displacement of the operating rod 16 articulated on the rod 17 in the direction of the arrow 31, i.e., towards a raised position. The shoe 15 connected to the bearing block 21, itself connected to the rod 16, is therefore displaced in the direction of the flange 5.

The displacement of the lever 19 brings about a displacement of the rod 23 in the direction of the arrow 30 and of the lock 22, the bolt of which comes into a retracted position.

The assembly 6 shown in locked position in FIG. 7 can be unlocked simply by tilting the operating key 19 in the direction represented by the arrow 28 in FIG. 6. This tilting gives rise both to a withdrawal of the shoes in the direction of the flange 5, i.e., into an unclamped position, and a displacement of the lock 22 into the unlocked position, with the result that the flange 5 can be tilted in the direction of the arrow 32 shown in FIG. 6, i.e., into its opened position.

Conversely, to close the flange and lock fuel assembly 6, starting from the position of the flange illustrated in FIG. 6, it is sufficient to turn down the flange 5 as a whole in the direction of the cradle 4 and then the key 19 in the direction of the flange 5; the key is locked in the clamping position by the mechanical locking means 27.

The clamping devices 25 and 26 are fastened to the corresponding branches of the flange 5 by means of flat supporting pieces 34 and 35. The branches of the flange 5 are in two parts connected to one another by means of the plates 34 and 35 which are welded to them.

As will be explained hereinbelow, the body of the clamping device is engaged in an orifice of the flat support 34 or 35 and is supported by a return spring, such as 36 or 37.

Figure 8:
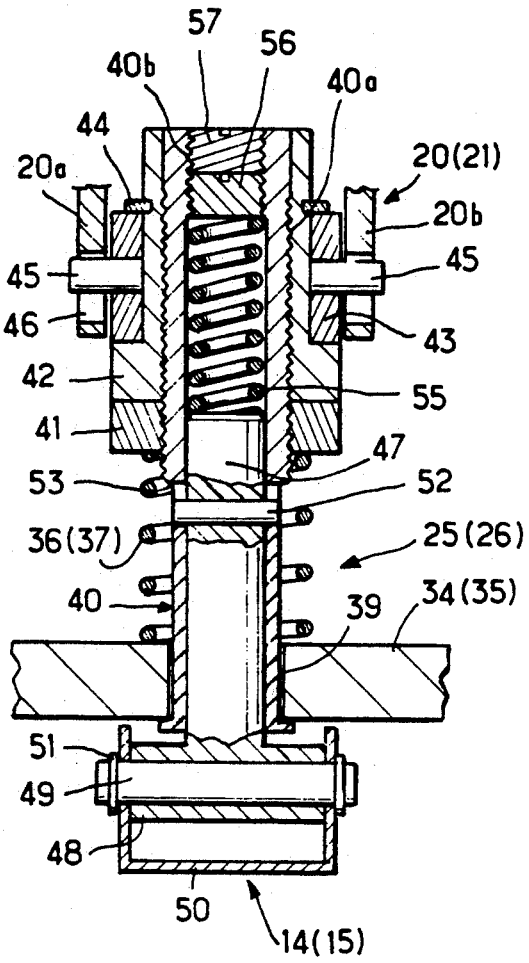
FIG. 8 is a view in axial section of a shoe for clamping the fuel assembly, in unclamped position.
Figure 9:
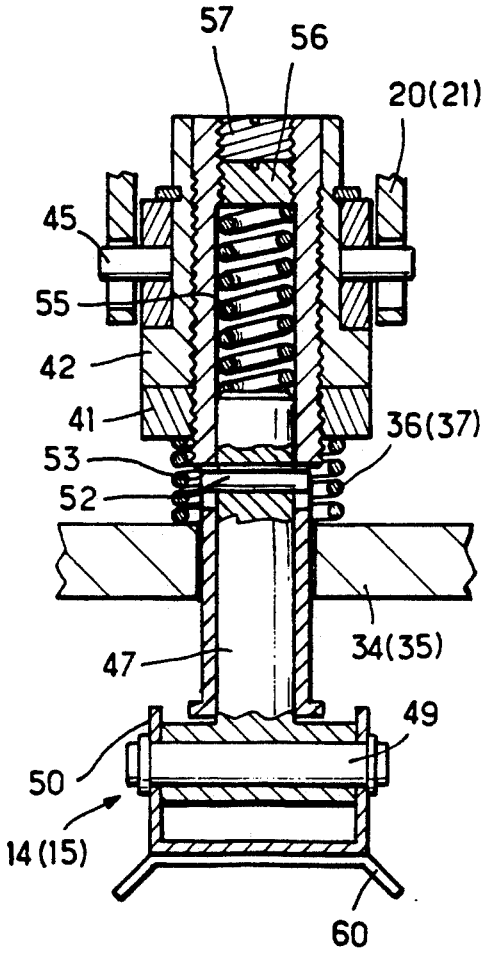
FIG. 9 is a view in axial section of a shoe for clamping the fuel assembly, in clamped position.

Referring to FIGS. 8 and 9, a fastening device, such as the device 25 or 26 illustrated in FIGS. 6 and 7, will now be described.

The device 25 (or 26) shown in FIGS. 8 and 9 comprises a tubular body 40 having an end part which is engaged in the orifice 39 of a bearing plate, such as 34 or 35, forming part of the flange 5 with which the fastening device 25 (or 26) is associated.

The tubular body 40 comprises an outer surface 40*a* which is threaded over some of its length and on which is engaged a nut 42 fastened in position on the body 40 by means of a lock nut 41.

The nut 42 makes it possible to adjust the length of the body 40 and therefore the position of the shoe 14 (or 15).

Slipped onto the outer part of the nut 42 is a bush 43 which comes to bear on a shoulder of the nut 42. The bush 43 is mounted for free rotation about the nut 42 and is held in the axial direction by a circlip 44 engaged in a groove machined on the outer surface of the nut 42.

The bush 43 carries two bearing dogs 45, on which are engaged the end parts of two branches 20*a* and 20*b* of the bearing block 20 (or 21) produced in the form of a fork. Each of the branches 20*a* and 20*b* comprises an oblong aperture 46, in which is engaged the end of the corresponding bearing dog 45.

A cylindrical rod 47 forming a piston is mounted slidably on the inside of the tubular body 40.

The rod 47 is solid, at one of its ends located outside the body 40, with a tubular shank 48, the axis of which is perpendicular to the axis of the rod 47 and of the tubular body 40.

A bearing sole 50 forming the contact part of the shoe 14 (or 15) is connected in an articulated manner to the end part of the sliding rod 47 by means of an axle 49 engaged in the tubular shank 48 and in the orifices of the sole 50 and blocked axially by circlips 51.

A substantially diametral orifice passes through the rod 47 in which orifice is engaged a pin 52, the ends of which project relative to the surface of the rod 47. The projecting ends of the pin 52 are engaged in oblong orifices 53 passing through the wall of the tubular body 40.

A helical spring 55 is interposed, on the inside of the tubular body 40, between the end of the rod 47 opposite the shoe and an abutment consisting of a threaded plug 56 screwed into an internally threaded part 40*b* of the inner bore of the tubular body 40.

The adjustment of the position of the plug 56 in the internally threaded orifice 40*b* makes it possible to adjust the compressive force of the spring 55. The plug 56 is maintained in its adjusted position inside the internally threaded bore 40*b* by means of a second threaded plug 57 engaged in the end part of the internally threaded orifice 40*b*.

When a clamping device does not bear against a grid of a fuel assembly, the rod 47 is maintained in the low position inside the tubular body 40 by the helical spring 55 which is compressed by the plugs 56 and 57. The pin 52 solid with the rod 47 comes to bear against the lower part of the oblong orifice 53 of the tubular body 40.

The helical spring 36 interposed between the plate 34 of the flange 5 and the lock nut 41 solid with the tubular body 40 ensures the return of the tubular body 40 and of the shoe 14 (or 15) into the high position in relation to the bearing plate 34 of the flange 5.

The shoe 14 (or 15) is brought to bear against an outer lateral wall of a grid 60 of a fuel assembly, as shown in FIG. 8, after the corresponding flange has been turned down in the direction of the assembly, by the displacement of the bearing block 20 (or 21) in the direction of the assembly and of the corresponding bearing surface of the cradle.

As explained above, the bearing block is displaced simply by turning down the key or lever 19 in the direction of the flange 5. The tubular body 40 is driven in the axial direction by means of the bearing dogs 45, the bush 43 and the nut 42. The body 40 exerts a push on the sliding rod 47 by means of the pin 52 engaged in the oblong orifices 53 of the tubular body 40.

During the displacement of the body 40 in the direction of the grid 60, the spring 36 (or 37) is compressed between the lock nut 41 and the bearing plate 34 (or 35). The sole 50 of the shoe 14 (or 15) comes to bear on the grid 60; the rod 47 is displaced in the direction of the flange 5 and no longer bears on the body 40. The clamping force is exerted by the precompressed spring 55. The clamping force exerted by the spring 55 by way of the rod 47 is preadjusted by means of the plugs 56 and 57.

This ensures a perfectly defined clamping of the fuel assembly between the shoe 14 (or 15) and the corresponding bearing surface of the cradle 4.

As a result of the axial mounting play at the ends of the pin 52 in the oblong orifices 53, the pin 52 and the rod 47 are free in terms of axial translational movement relative to the tubular body 40, so that the clamping is carried out solely by means of the spring 55.

Figure 10:
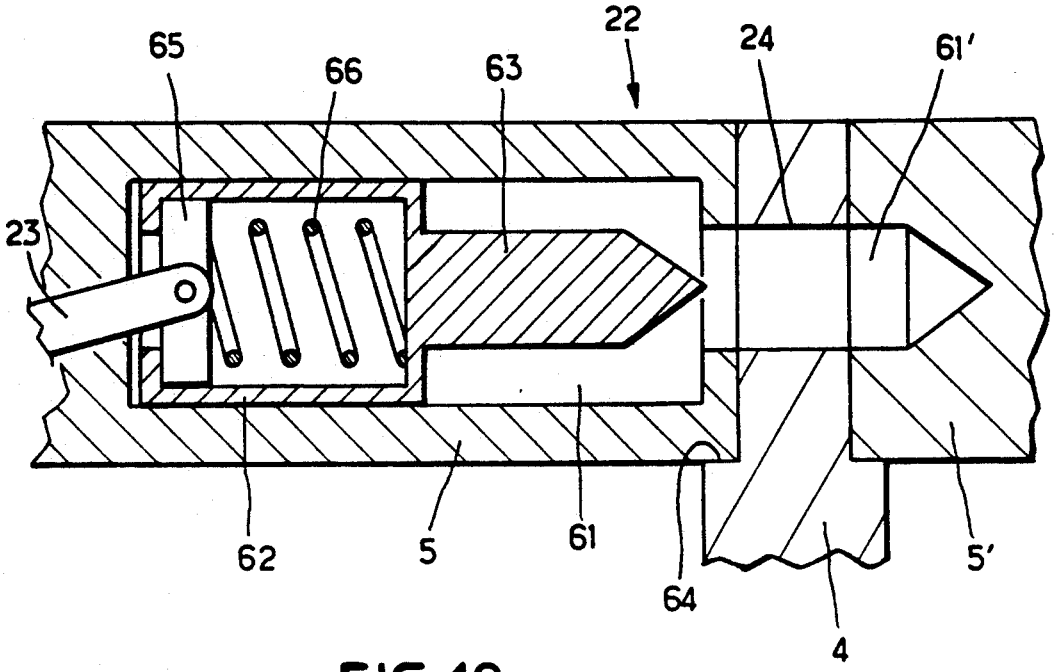
FIGS. 10 and 11 are sectional views of a device for locking flanges on the cradle of a transport container for fuel assemblies.
Figure 11:
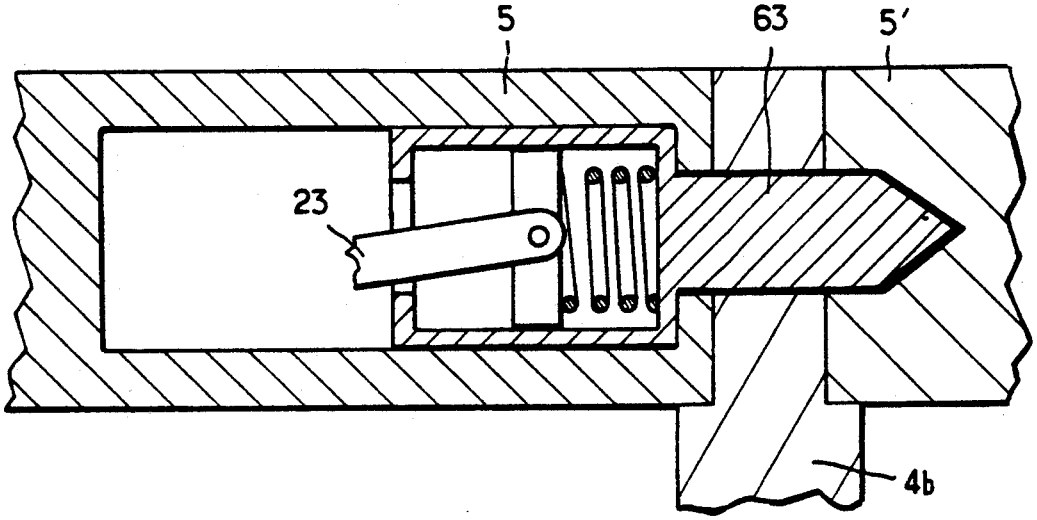

Referring to FIGS. 10 and 11, the functioning of the lock 22, which is put into the locking position prior to the clamping of the shoes 14 and 15 of the devices 25 and 26 of the flange 5, will now be described.

The lock 22 comprises a hollow body 62 mounted slidably in an orifice 61 inside the flange 5 and at the end of this flange which, when it is turned down, comes into coincidence with the upper part of the partition wall 4*b* of the cradle 4. The orifice 61 is in the exact extension of the orifice 24 of the partition wall 4*b* when the flange 5 is in the turned-down position bearing on a shoulder 64 of the partition wall 4*b*.

A flange 5' mounted on the cradle 4 in an arrangement symmetrical relative to the arrangement of the flange 5 with respect to the partition wall 4 comprises an orifice 61' which, in the turned-down position of the flange 5', comes into alignment with the orifices 61 and 24.

The end part of the lock body 62 forms a bolt 63 which is capable of engaging in the aligned orifices 61, 24 and 61' in the locking position, as shown in FIG. 10.

The actuating rod 23 articulated on the operating key 19 is connected in an articulated manner, at its end opposite the operating key 19, to a piston 65 mounted movably within the lock body 62 and bearing on a helical spring 66 interposed between the piston 65 and the bottom of the hollow part of the jack body 62.

When the operating key 19 is being turned down in the direction of the flange 5, the operating rod 23 exerts a push on the piston 65 and, by means of the spring 66, on the lock body 62 and on the bolt 63. The lock body 62 and the bolt 63 are displaced within the orifice 61 of the flange 5 so as to come into the locking position shown in FIG. 11.

This brings about, in a single operation, the locking of the free ends of the flanges 5 and 5' on the cradle 4 and the clamping of the fuel assembly by means of the shoes, such as 14 and 15.

In fact, for the same storage container, all the clamping flanges arranged opposite the grids of the assembly are equipped with a locking device, as shown in FIGS. 10 and 11, ensuring the simultaneous locking of the two flanges arranged on either side of the partition wall of the cradle, with the exception of the two flanges located level with the end spacer grids of the assembly, i.e., level with the lower grid and level with the upper grid of the assembly, and of a third flange placed in an intermediate position. The flanges not equipped with an interlocking device on either side of the partition wall 4*b*, as shown in FIGS. 9 and 10, comprise a locking device independent of the device for locking the flange located in a position symmetrical relative to the partition wall of the cradle.

When the fuel assemblies are being put in place in the container by the use of a lifting means which can consist of the winch of a travelling crane, the fuel assemblies are held by the lifting means in a position such that the outer surfaces of their spacer grids are opposite and at a short distance from the corresponding bearing surfaces of the cradle of the container.

The flanges comprising independent locking means are then turned down, and the fastening devices of these flanges are put into the clamping position so as to place a fuel assembly in its transport position on the cradle. This operation is carried out in succession for each of the two fuel assemblies put in place in the container.

The two assemblies are subsequent flanged simultaneously by actuating the operating keys of all the flanges of a fuel assembly.

The second assembly is subsequently locked by turning down and locking the corresponding operating keys.

The device according to the invention thus makes it possible to clamp very quickly a component, such as a fuel assembly, against one or more bearing surfaces, simply by the manual actuation of an operating member, such as a key or a lever.

As regards a device for locking fuel assemblies inside a transport container, according to the invention the putting in place and effective fastening of the fuel assemblies in the container are carried out very quickly and without having to conduct a check of the clamping of screw connections.

It is also clear that unlocking of the fuel assemblies before they are separated from the transport cradle can be conducted simply and quickly by unlocking and raising the operating keys associated with the successive flanges holding the assemblies.

The loading and unloading of fuel assemblies in transport containers can therefore be carried out by unqualified personnel and in a much shorter time than was the case in the prior art.

Insofar as these operations can involve a very large number of fuel assemblies after their production or before their loading into the core of a nuclear reactor, the cumulative time saving can be extremely great.

Furthermore, the risks of damage to the fuel assemblies are greatly reduced insofar as the clamping forces on the spacer grids are fixed and set before the operations of putting the assemblies in place in the containers.

The means of manual displacement of the tubular body of the fastening device may be other than an operating key or lever. The means of connection between the tubular body and these displacement means may also be different from those described.

The tubular body may comprise means for adjusting the amount of displacement of the shoe and the clamping force of this shoe are different from those which described and which consist of nuts or threaded plugs.

The bearing shoes may have any form matched to the form of the corresponding bearing surfaces of the fuel assemblies.

Finally, the device according to the invention can be used not only for clamping fuel assemblies in their transport container, but also for ensuring the flanging and clamping of any component of large mass on a transport structure.

I claim:

1. In a transport structure having at least one bearing surface supporting an object, and a flanging part located opposite said bearing surface, a device for fastening said object comprising (a) a tubular body mounted for axial movement on said flanging part between a clamping position and an unclamped position;

(b) first means for elastic return of said tubular body towards its unclamped position, said first means being interposed between said tubular body and said flanging part;

(c) means for manual axial displacement of said tubular body between said unclamped position and said clamping position, said means being carried by said flanging part and comprising means for locking in said clamping position on said flanging part;

(d) a rod mounted for limited axial sliding movement within said tubular body and having a first end carrying, outside said tubular body, a shoe directed towards said bearing surface of said transport structure; and (c) a second elastic return means, interposed between an abutment fastened to said tubular body and a second end of said rod opposite said shoe, in order to return said sliding rod and said shoe in a direction of said bearing surface.

2. Device according to claim 1, wherein said tubular body comprises an outer threaded part on which is engaged a nut by means of which said tubular body is connected to said displacement means, the nut enabling adjustment of an axial position of said tubular body and of said shoe in relation to a bearing surface of said object which is being fastened.

3. Device according to claim 1 or 2, wherein said tubular body comprises a bore with an internally threaded part, and wherein said abutment of said second elastic return means consists of a threaded plug, axially adjustable within said internally threaded part of said bore of said tubular body, in order to adjust the return force of said second elastic means in the direction of said bearing surface.

4. Device according to claim 1 or 2, wherein said abutment of said sliding rod consists of a pin engaged in a substantially diametral direction through said sliding rod and comprising ends projecting relative to an outer surface of said sliding rod and engaged in oblong orifices passing through a wall of said tubular body.

5. Device according to claim 1 or 2, wherein said tubular body is mounted for sliding movement in an orifice passing through said flanging part.

6. Device for locking at least one fuel assembly inside a transport container comprising a cradle having at least one set of two right-angled bearing surfaces for said fuel assembly and a plurality of locking flanges mounted in an articulated manner on said cradle about an axis parallel to a longitudinal axis of said cradle, said locking flanges being equipped with devices for fastening said fuel assembly against said bearing surfaces of said cradle, each of said flanges being in one-piece form and comprising two branches at 90°, a free end of one of said branches being articulated on said cradle about an axis parallel to said longitudinal direction of said cradle, wherein each of said fastening devices comprises (a) a tubular body mounted for axial movement on said flange between a clamping position and an unclamped position;

(b) a first means for elastic return of said tubular body towards its unclamped position, interposed between said tubular body and said flanging part;

(c) means for manual axial displacement of said tubular body between its unclamped position and its clamping position, the displacement means carried by said flange ensuring displacement of tubular bodies of the two fastening devices carried by said flange and comprising means for locking on said flange in said clamping position;

(d) a rod mounted for limited axial sliding movement within said tubular body and having a first end carrying, outside said tubular body, a shoe directed towards said bearing surface of said transport structure; and (e) a second elastic return means, interposed between an abutment fastened to said tubular body and a second end of said rod opposite said shoe, in order to return said sliding rod and said shoe in the direction of said bearing surface of said cradle.

7. Locking device according to claim 6, wherein said means for manual displacement of said tubular body of said fastening devices carried by said flange consists of a manual lever articulated on said flange, of a first bearing block connected to said tubular body of a first fastening device and displaceable by means of said lever, of an articulated set comprising two actuating rods articulated on one another and connected in an articulated manner one to said operating lever and the other to said flange, and of a second bearing block connected to said tubular body of a second fastening device and displaceable by means of one of said operating rods.

8. Locking device according to claim 7, further comprising a lock having a locking part connected to a first end of an operating rod, a second end of said operating rod being fastened in an articulated manner to said lever, whereby, upon tilting of said lever in the direction of said flange, a free end of said flange is locked on said cradle as a result of introduction of said locking part of said lock into an orifice of said cradle, and then said fuel assembly is clamped as a result of actuation of said fastening devices by means of said bearing blocks.

9. Locking device according to claim 8, wherein said movable locking part of said lock consists of a hollow jack body which is solid with a locking bolt and within which is mounted an actuating piston connected in an articulated manner to the end of said operating rod, a helical spring being interposed between said piston and a bottom of said hollow lock body solid with said bolt.

10. Locking device according to claim 8 or 9, wherein said cradle of said transport container comprises a partition wall between two zones for bringing to bear two fuel assemblies, comprising an orifice passing through said partition wall, in which orifice said movable locking part of said lock is capable of engaging in order to simultaneously lock two flanges arranged on either side of said partition wall.

* * * * *